US010077403B2

(12) United States Patent
Pattom et al.

(10) Patent No.: US 10,077,403 B2
(45) Date of Patent: Sep. 18, 2018

(54) NOZZLES FOR A FLUID JET DECOKING TOOL

(75) Inventors: Matthew J. Pattom, San Gabriel, CA (US); Lloyd D. Hanson, Long Beach, CA (US)

(73) Assignee: Flowserve Management Company, Irving, TX (US)

( * ) Notice: Subject to any disclaimer, the term of this patent is extended or adjusted under 35 U.S.C. 154(b) by 1125 days.

(21) Appl. No.: 12/772,577

(22) Filed: May 3, 2010

(65) Prior Publication Data

US 2010/0276506 A1 Nov. 4, 2010

Related U.S. Application Data

(60) Provisional application No. 61/175,260, filed on May 4, 2009.

(51) Int. Cl.
*C10B 33/00* (2006.01)

(52) U.S. Cl.
CPC ..... *C10B 33/006* (2013.01)

(58) Field of Classification Search
CPC C10B 33/006; B05B 1/02; B05B 1/14; B05B 1/34
USPC ..... 239/553, 589, 590, 601
See application file for complete search history.

(56) References Cited

U.S. PATENT DOCUMENTS 2,217,360 A 10/1940 Court
2,218,130 A 10/1940 Court
2,225,521 A 12/1940 Holveck
3,137,354 A * 6/1964 Crawford et al. ..... 175/340
3,612,409 A * 10/1971 Henning ..... 239/602
3,921,915 A * 11/1975 Glenn et al. ..... 239/589
3,968,931 A * 7/1976 Smith ..... 239/125
4,275,842 A 6/1981 Purton et al.
5,816,505 A 10/1998 Tran et al.
6,644,567 B1 11/2003 Adams et al.
7,163,165 B2 1/2007 Paul et al.
7,819,343 B2 * 10/2010 Paul et al. ..... 239/446

FOREIGN PATENT DOCUMENTS

WO 03014261 A1 2/2003

OTHER PUBLICATIONS

International Search Report and Written Opinion relating to PCT Application No. US2010/033518, dated Sep. 27, 2010.
Office Action dated Dec. 11, 2013 pertaining to Russian Patent Application No. 2011145399.
Mexican Official Action dated Jan. 12, 2014, pertaining to Mexican Patent Appln. No. MX/a/2011/011655.
(Continued)

*Primary Examiner* — Christopher Kim
(74) *Attorney, Agent, or Firm* — Dinsmore & Shohl LLP

(57) ABSTRACT

A fluid jet nozzle for a decoking tool, a decoking tool and method of operating same. The nozzle includes a nozzle assembly for use in a fluid jet decoking tool. The assembly includes a housing to hold one or more nozzles that are used to spray or otherwise distribute decoking fluid. An internal flowpath that extends from an inlet of the nozzle to an outlet of the nozzle defines a tapered shape such that when the decoking fluid passes through the nozzle, the flowpath produces a predominantly coherent flow pattern in the fluid.

8 Claims, 3 Drawing Sheets

(56) References Cited

OTHER PUBLICATIONS

Mexican Office Action dated Sep. 19, 2014 pertaining to Mexican Patent Application No. MX/a/2011/011/011655 entitled "Improved Nozzles For A Fluid Jet Decoking Tool".
Mexican Office Action dated Dec. 19, 2014 pertaining to Mexican Patent Application No. MX/a/2011/011/011655 entitled "Improved Nozzles For A Fluid Jet Decoking Tool".

* cited by examiner

NOZZLES FOR A FLUID JET DECOKING TOOL

This application claims the benefit of the filing date of U.S. Provisional Application No. 61/175,260, filed May 4, 2009.

BACKGROUND OF THE INVENTION

This invention relates generally to tools for removing coke from containers such as coking drums used in oil refining, and more particularly to improvements in cutting and drilling nozzle designs for use in a decoking tool.

In conventional petroleum refining operations, crude oil is processed into gasoline, diesel fuel, kerosene, lubricants or the like. It is a common practice to recover heavy residual hydrocarbon byproducts through a thermal cracking process known as delayed coking. In a delayed coker operation, heavy hydrocarbon (oil) is heated to a high temperature (for example, between 900° F. and 1000° F.) in large fired heaters known as a fractionation unit, and then transferred to cylindrical vessels known as coke drums which are as large as 30 feet in diameter and 140 feet in height, and typically configured to operate in pairs. The heated oil releases its hydrocarbon vapors (including, among other things, gas, naphtha and gas oils) to the base of the fractionation unit for processing into useful products, leaving behind, through the combined effect of temperature and retention time, solid petroleum coke. This coke residue must be broken up in order to remove it from the vessel, and is preferably accomplished by using a decoking (or coke cutting) tool in conjunction with a decoking fluid, such as high pressure water.

Such a tool includes a drill bit with both drilling and cutting nozzles. The tool is lowered into the vessel through an opening in the top of the vessel, and the high pressure water supply is introduced into the tool so that it can be selectively routed through either the drilling or cutting nozzles of the bit to act as a fluid jet, depending on the mode of operation. Since high flow rates and pressures (for example, flows of 1000 gallons per minute (gpm) at 3000 to 4000 pounds per square inch (psi)) are typically used for such operations, it is neither practical nor desirable to open drilling and cutting nozzles at the same time. Instead, it has been advantageous to employ diverter valves or other flow control devices to selectively direct the flow to either the cutting nozzles or the drilling nozzles, depending on which part of the decoking operation the tool is in at that time. A couple of examples of decoking tools employing mode-shifting attributes are depicted in U.S. Pat. No. 5,816,505 (for manual mode shifting) and U.S. Pat. No. 6,644,567 (for automated mode shifting); both are commonly owned by the Assignee of the present invention, and also incorporated herein by reference.

Regardless of whether a decoking tool uses mode-shifting features, the relatively large size of the tool, coupled with the generally outward-pointing cutting nozzles, means that it must form a significant radial profile in the bed of coke being cut. A conventional tool is approximately 22 inches in diameter and 35 inches long, while the nozzle assembly dimensions are slightly over 5 inches in length with an outer diameter at the inlet of about 3.75 inches and an outer diameter at the exit of about 1.875 inches. This large size exacerbates the tendency of the tool to get stuck, especially in situations where the bored-out passageway formed in the coke may already be compromised, such as when the coke bed collapses or gets stuck with coke pieces that have been liberated by the force of the decoking fluid emanating from the cutting nozzles. Under such a situation, the tool could get stuck, requiring difficult and time consuming steps to free it.

In addition to large physical dimensions, conventional cutting and drilling nozzles tend to exhibit a larger-than-necessary pressure drop. Much of this stems from an unnecessarily large radial profile caused in the plane of ejection of the decoking fluid at the nozzle tip. The conventional nozzle was relatively long in order to accommodate the large number of drilled flow passages, while the large radial dimension reflects the need for numerous such passages. In addition, various components making up the nozzle are formed as an assembly made up of multiple pieces that may necessitate complex machining and related manufacturing.

It is desirable to create nozzles for a decoking tool that avoid one or more of the shortcomings mentioned above.

SUMMARY OF THE INVENTION

These desires are met by the present invention, where decoking fluid nozzles are provided with enhanced flow attributes. The surfaces of the internal flowpaths define a generally tapered or converging shape that can reduce the radial components of the flow velocity, and in a likewise manner can reduce the standard deviation of the axial component of the decoking fluid flow. Because the standard deviation in axial velocity is representative of any deviation from the mean value, the present inventors have determined that optimizing the nozzle shape (such as by running an optimization routine) forces this parameter to be minimum, and that this results in a nozzle that produces a jet where the flow velocity across a cross section is as close to the mean as possible, and that such a uniform jet is most effective in cutting coke in the decoking process. By such improvements in flowpath tailoring, the size (in particular, the axial length) of the nozzle can be reduced, while still providing the necessary jet impact force and jet coherence. Such size reduction (as well as part number reduction) improves manufacturability and operability.

According to one aspect of the present invention, a nozzle assembly for use in a fluid jet decoking tool is disclosed. The assembly includes a housing with conduit formed therein that is sufficient to convey decoking fluid (such as pressurized water) to one or more nozzles that are fluidly coupled to the conduit. The nozzle includes a fluid inlet, a fluid outlet and an internal flowpath extending from the inlet to the outlet. The flowpath defines a tapered shape such that when the decoking fluid passes through the nozzle, a flow pattern formed thereby is predominantly coherent. Such coherence is achieved by prevention of stagnant areas and large eddy flows. The wall boundary layer is also minimized to reduce turbulence losses.

Optionally, there are numerous nozzles formed in the housing. Such nozzles may include one or more cutting nozzles and one or more drilling nozzles. In a preferred form, a substantial majority of the nozzle does not protrude laterally beyond an outer dimension defined by the housing. In other words, the presence of the nozzles in the assembly does not appreciably widen or lengthen the assembly's housing. While a precise demarcation of what it means to have the nozzles not appreciably extend the footprint and related dimensions of the housing is not discussed, certain ranges can be used to serve as an example. For example, in nozzles used in a conventional decoking tool (such as those shown and discussed below in conjunction with the prior art), the drilling nozzles may extend the overall assembly length dimension by up to 40% or more, while the cutting nozzles may extend the overall radial or width dimension by up to 60% or more. Such dimensions are considerably larger than the 0% to approximately 10% that the nozzles of the present invention can increase housing footprints.

Relatedly, a majority of the structure making up the nozzle (including the structure that gives definition to the inlet, outlet and intermediate flowpath formed between the inlet and outlet) fits within (or almost entirely within) the existing housing structure. As such, it is substantially enclosed within the housing. This is particularly applicable to the cutting nozzles, where only the edge adjacent the nozzle outlet is outside of the housing. As with the discussion above of how much the nozzle extends the dimensions of the assembly housing, a precise demarcation of what it means to have a portion of the nozzle or nozzles extend beyond that of the housing is not discussed. Nevertheless (as above), certain ranges can be used to serve as an example. In nozzles used in a conventional decoking tool (such as those shown and discussed below in conjunction with the prior art), both the drilling and cutting nozzles may have 60% or more of the nozzle structure extend outside of the housing, whereas in the nozzles of the present invention, no more than about 15% of the length of the cutting nozzles and no more than about 25% of the length of the drilling nozzles resides outside the housing.

In additional options, the nozzle can be substantially fixed relative to the housing such that it doesn't pivot or otherwise move, thereby promoting a constant cutting angle for the cutting nozzles and a relatively fixed drilling angle for the drilling nozzles. In another optional features, the nozzles may include a flow conditioning chamber formed immediately upstream of the fluid inlet. This chamber mitigates any pre-swirl that arises as a result of the fluid motion through the tool body. Pre-swirl is an undesired phenomenon, as it contributes to the radial velocity component as the jet exits the nozzle. The internal flowpath is preferably optimized to achieve the highest degree of nozzle performance indicia, preferably at least one of (a) minimal radial velocity, (b) minimal axial flow non-uniformity and (c) minimal axial length for the nozzle. In the present context, the term "optimizing" and its variants is meant to specifically include those flowpath configurations that have been run through at least one computational fluid dynamics (CFD) computation to determine which flowpath profile would produce the best (or optimum) of one or more of the nozzle performance indicia identified above. In one form, the CFD process can be used to achieve flowpath optimization. For example, two nozzle profiles can be used, where one produces a linear velocity gradient along the length of the nozzle, and another produces a linear pressure gradient along the length of the nozzle. These could be represented mathematically using Bezier curves and used as starting points for the optimization process. It will be appreciated by those skilled in the art that other mathematical representation besides Bezier curves can serve the purpose. By varying the parameters that define the curve, multiple simulation runs can be carried out to identify the optimal region that satisfied the three performance criteria stated above.

According to another aspect of the invention, a fluid jet decoking tool is disclosed. The tool includes a decoking fluid delivery mechanism that can receive a pressurized decoking fluid from a source, and a nozzle assembly that can be placed in fluid communication with the source through the mechanism. In one form, the decoking fluid delivery mechanism is in the form of a delivery tube, pipe, hose or related conduit. The assembly includes a housing with one or more decoking fluid conduit lines formed therein, as well as one or more of each cutting nozzles and drilling nozzles. The housing may form a separate structure that can be secured to a decoking tool body (such as through fastening, friction fit or other suitable means), or it can be a part of the tool body, such as through integral formation or the like. In either situation, it is likely that the maximum lateral (or radial) dimension of the portion of the decoking tool that traverses a decoking vessel will be defined by the assembly's housing will (along with the nozzles). Each of the drilling and cutting nozzles can be placed in selective fluid communication with the conduit in the tool body. A valve or related flow diverting mechanism is disposed in flowpaths formed between the nozzles and the conduit in the tool body to permit selective routing of the decoking fluid through the housing such that during a particular one of the cutting and drilling operations, the nozzle or nozzles not then in use are substantially fluidly decoupled from the source. Furthermore, the nozzles may include an internal flowpath defining a tapered shape such that upon passage of the decoking fluid through the nozzle, a flow pattern formed by the decoking fluid as it exits the nozzle exhibits a predominantly coherent pattern.

In a more particular form of the decoking tool, the valves are operated upon by the mode shifting apparatus that routes the decoking fluid to one or the other of the drilling and cutting nozzles. In another option, the one or more nozzles are placed within the decoking tool body so that a majority of the structure making up the nozzle fits within a footprint formed by the tool body. This allows at least the radially-outward projection of the tool due to the nozzles to be reduced. As before, the construction of the assembly can be made to ensure that most of the nozzle's profile is contained within the tool body so that the nozzle outlet is either entirely or almost entirely within the outer dimension defined by the tool. In another option, a substantial majority of the at least one cutting nozzle does not protrude laterally beyond an outer dimension defined by the decoking tool body. More particularly, such a substantial majority may be a substantial entirety. The assembly may also be structured so that one or more of the nozzles are substantially fixed relative to the tool body, while a particular form of the nozzle is such that it includes a flow conditioning chamber formed immediately upstream of the fluid inlet and in fluid communication with the conduit. As with the previous aspect, the internal flowpath is preferably optimized to achieve one or more of (a) minimal radial velocity, (b) minimal axial flow non-uniformity and (c) minimal axial length for the nozzle.

According to yet another aspect of the invention, a method of passing a decoking fluid through a nozzle is disclosed. The method includes configuring one or more nozzles to allow decoking fluid to pass through, where the nozzle or nozzles include an internal flowpath that defines a tapered shape. In addition, the method includes providing the decoking fluid to the nozzle or nozzles such that a flow pattern formed by the decoking fluid as it passes through is predominantly coherent.

Optionally, the method further includes passing the decoking fluid through at least one drilling nozzle and at least one cutting nozzle. The method may additionally include selectively routing the decoking fluid through one or the other of the cutting and drilling nozzles at any given time. Such selective routing can be achieved by using a mode shifting apparatus in general, and in more particular, with an automated mode shifting apparatus that uses changes in decoking fluid pressure to shift between cutting and drilling modes. In a particular form, the method includes running one or more CFD calculations to help design the nozzle, where a particular emphasis is on designing the nozzle flowpath in accordance with the output generated by the CFD calculation. The output generated that is particularly beneficial to designing a nozzle according to the present invention includes that associated with one or more of (a) minimal radial velocity, (b) minimal axial flow non-uniformity and (c) shortest axial length of the nozzle as possible. In one other option, the flow conditioning chamber can be included to reduce or eliminate any pre-swirl that may have arisen as a result of the fluid motion through the tool body.

BRIEF DESCRIPTION OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1:
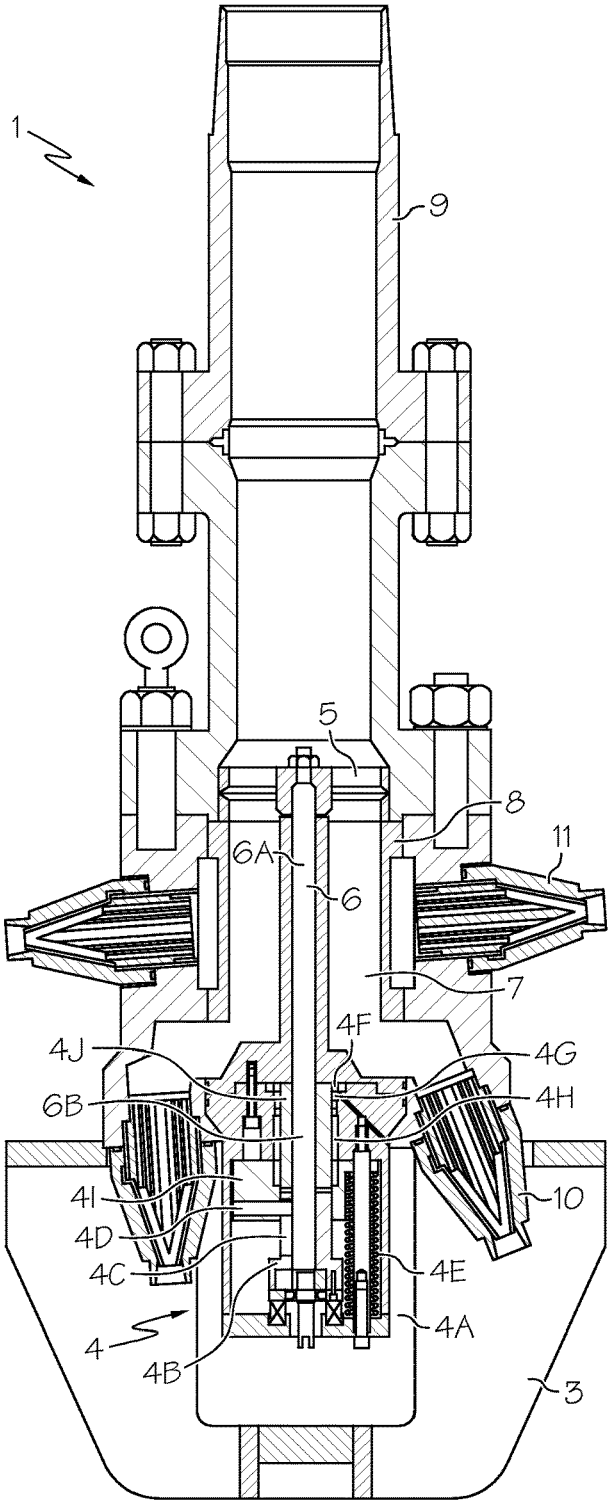
FIG. 1 (PRIOR ART)
FIG. 1 is a cutaway view of a combination coke cutting tool and mode shifting apparatus according to an aspect of the prior art.

Referring first to FIG. 1, a conventional decoking tool 1 with protective boring blades or vanes 3 and a mode shifting apparatus 4 installed in the tool 1 is shown. The mode shifting apparatus 4 is made up of numerous components, including a body 4A, actuator sleeve 4B, actuator slot 4C, actuator pin 4D, spring 4E, pressurized fluid inlet 4F, annular hydraulic cylinder 4G, annular piston 4H, actuator pin carrier 4I and a liner sleeve 4J that surrounds a lower portion 6B of a control rod 6 that also includes an upper portion 6A. The control rod 6 is connected to a hydraulic distribution diversion plate (also called diverter plate) 5 such that when the mode shifting apparatus 4 is activated, either manually or by sequentially pressurizing and de-pressurizing operations from a fluid supply (not shown), the control rod 6 rotates the diverter plate 5, causing openings formed through the axial dimension thereof to alternately expose fluid delivery conduit 7 and either the drilling nozzles 10 or cutting nozzles 11 to a supply of high pressure fluid (for example, water) being delivered through an inlet pipe or drill stem 9. In the version depicted in FIG. 1, the drilling nozzles 10 are in fluid communication with the pressurized fluid supply in order to direct a generally downward stream of high pressure fluid into the coke (not shown), thereby boring a hole for the rest of the apparatus 4 to follow. The generally planar disk-like shape of the diverter plate 5, coupled with its rotatable mounting arrangement to control rod 6 permits shifting between a cutting mode and a drilling mode to occur by an intermittent clocking rotation of the diverter plate 5. The details of the construction and operation of diverter plate 5 will not be repeated herein, suffice to say that such details may be found in commonly-owned U.S. Pat. No. 6,644,567.

Figure 2:
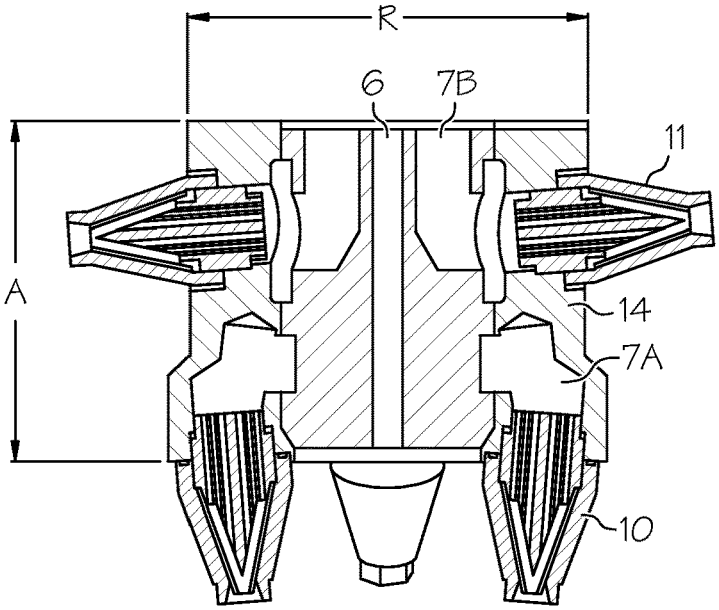
FIG. 2 (PRIOR ART)
FIG. 2 is a detail view showing the nozzle assembly from the tool of FIG. 1.
Figure 3:
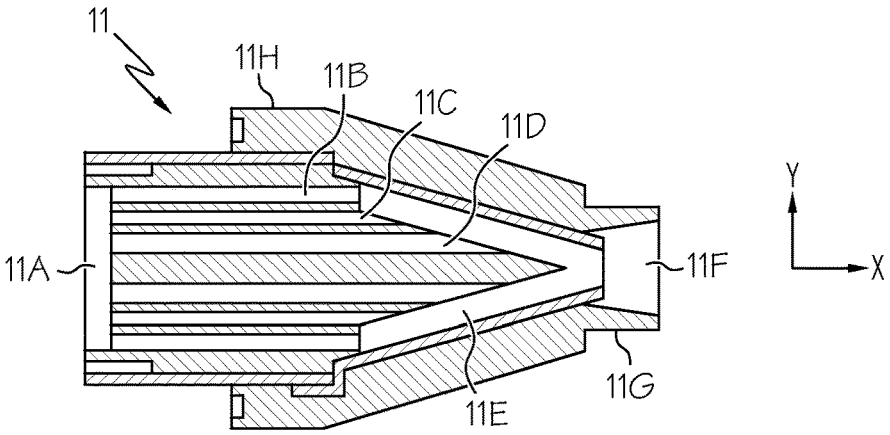
FIG. 3 (PRIOR ART)
FIG. 3 is a detail view showing an internal flowpath of one of the nozzles from the tool and assembly respectively of FIGS. 1 and 2.

Referring with particularity to FIGS. 2 and 3, the drilling nozzles 10 and cutting nozzles 11 of the prior art are shown, where the assembly that includes the nozzles 10 and 11 also include a housing H that defines a radial dimension R and an axial dimension A. As can be seen, the drilling nozzles 10 extend axially a significant distance beyond the axial dimension A, while the cutting nozzles 11 extend radially a significant distance beyond the radial dimension R. Furthermore, these nozzles 10 and 11 are made up of numerous discrete flow tubes or channels that keep their respective fluid streams isolated from one another over a substantial majority of the nozzle length. Cutting nozzle 11 (which has attributes similar to those of drilling nozzle 10) shows in inlet at conditioner 11A and an outlet 11F, as well as the discrete flow channels 11B, 11C and 11D that can be in the form of concentric tubes, clustered "soda straws" or any other well-known arrangement. As shown, all of the separate flow channels dump the decoking fluid into a common header 11E, and in the process subjects the flow to abrupt angle changes as it makes its way toward the outlet 11F. Such abrupt changes can produce friction, turbulence and other anomalies that may adversely affect the quality of flow being discharged through nozzle 11. These anomalies may be exacerbated by flow separation, such as that which could arise in the discontinuity formed in liner nozzle (also called the nozzle insert) 11G that is formed fluidly upstream of the throat formed where the header 11E meets the outlet 11F. All of these factors may contribute to reductions in the flow's axial component as it exits the nozzle 11 at outlet 11F. Referring with particularity to FIG. 3, the three main parts of the assembly that make up the cutting nozzle 11 are shown, where the conditioner 11A, the liner nozzle 11G and the housing cap 1111 are used in conjunction with the flow channels 11B, 11C and 11D, common header 11E and outlet 11F to direct the flow of pressurized water. The liner nozzle 11G collects the flow from the conditioner 11A and accelerates it to the outlet 11F that could be machined to vary the exit area (and flow coefficient) of the nozzle. The housing cap 11H provides a sealed pressure boundary, and additionally aligns the flow conditioner 11A and erosion-resistant nozzle insert 11G.

Figure 4:
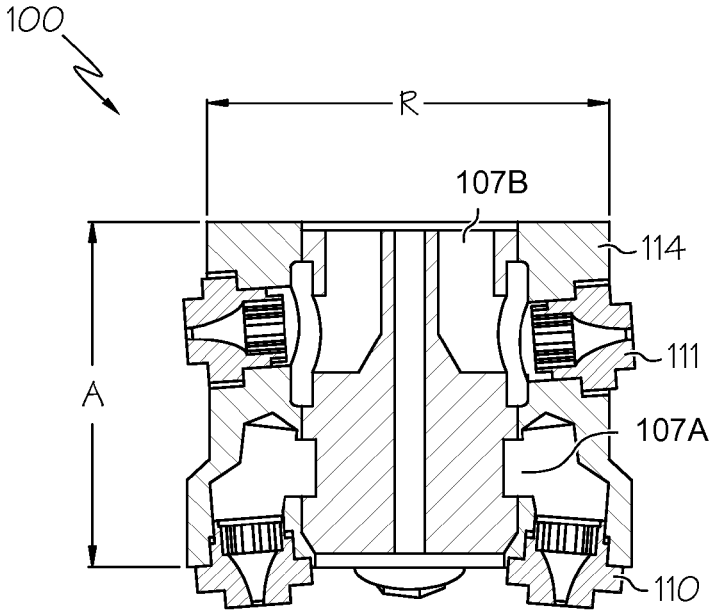
FIG. 4 is a detail view showing a nozzle assembly according to an aspect of the present invention.
Figure 5:
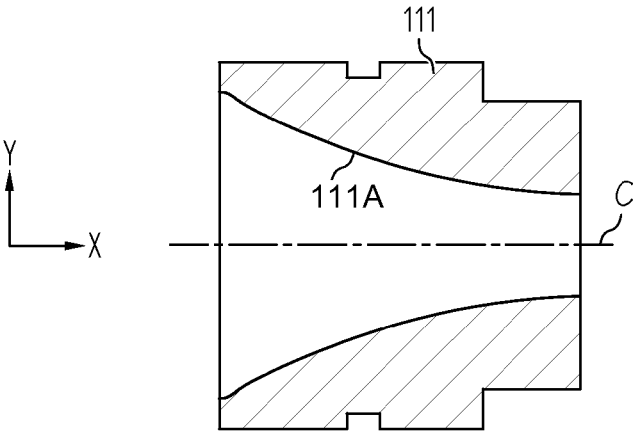
FIG. 5 is a detail view showing an internal flowpath of one of the nozzles of the present invention.

Referring next to FIGS. 4 and 5, features associated with an assembly 100 and the nozzles 110, 111 of the present invention are disclosed. The assembly 100 includes housing 114 that includes conduit 101A 407B that act as fluid passageways to deliver decoking fluid that comes from a pressurized source (not shown) to the drilling nozzles 110 and cutting nozzles 111. Referring with particularity to FIG. 5, a cutting nozzle 111 is shown, although it will be appreciated that the structure and flowpath depicted therein is equally applicable to the drilling nozzle 110. Unlike the conventional flowpath depicted in FIG. 3, the internal surface of FIG. 5 may define a generally curvilinear tapered converging shape 411A that is optimally-shaped for decoking fluid jet spraying, and was achieved using a CFD calculation to achieve minimal radial velocity, minimal non-uniformity in the axial flow, in the shortest nozzle length possible. The present inventors have discovered that by optimizing the nozzles in the manner shown for coke cutting operations, a more columnar, coherent flow is produced, as the radial components of the flow velocity are minimized. By such improvements in flowpath tailoring, the size of the nozzles 110, 111 relative to nozzles 10, 11 of FIGS. 2 and 3 (particularly, their axial dimension) can be reduced, while still providing the necessary jet impact force and jet coherence. Such size reduction (as well as part number reduction) improves manufacturability, and allows for simpler drilling due in part to the smaller bore profile. The present inventors have employed CFD modelling and bench testing as a way to optimize the internal flowpath shape 411A based upon the particular needs of the decoking tool and its environment. By reducing or preventing stagnant areas and large eddy flows, the nozzle flowpath can preserve a high degree of flow coherence.

Referring with particularity to FIG. 5 in conjunction with the data of Table 1, views and dimensions of internal water flowpaths for the cutting nozzle 111 is also shown. It will be appreciated that the features discussed below for cutting nozzle 111 are equally applicable to drilling nozzle 110, and therefore will not be repeated. Table 1 below shows the representative X and Y dimensions of the internal flowpath surface of a nozzle made in conjunction with the present invention where a CFD algorithm was employed:

TABLE 1

| NOZZLE DIMENSIONS | |
|---|---|
| X (inches) | Y (inches) |
| 0.0000 | 0.8400 |
| 0.0169 | 0.8389 |
| 0.0317 | 0.8351 |
| 0.0442 | 0.8297 |
| 0.0549 | 0.8235 |
| 0.0640 | 0.8172 |
| 0.0720 | 0.8110 |
| 0.0791 | 0.8051 |
| 0.0856 | 0.7996 |
| 0.0916 | 0.7946 |
| 0.0972 | 0.7899 |
| 0.1025 | 0.7856 |
| 0.1077 | 0.7817 |
| 0.1128 | 0.7781 |
| 0.1179 | 0.7748 |
| 0.1231 | 0.7718 |
| 0.1283 | 0.7687 |
| 0.1338 | 0.7655 |
| 0.1402 | 0.7619 |
| 0.1473 | 0.7578 |
| 0.1552 | 0.7534 |
| 0.1639 | 0.7485 |
| 0.1735 | 0.7433 |
| 0.1840 | 0.7376 |
| 0.1954 | 0.7315 |
| 0.2077 | 0.7250 |
| 0.2210- | 0.7181 |
| 0.2353 | 0.7107 |
| 0.2506 | 0.7030 |
| 0.2669 | 0.6948 |
| 0.2842 | 0.5863 |
| 0.3026 | 0.6774 |
| 0.3220 | 0.6681 |
| 0.3424 | 0.6585 |
| 0.3640 | 0.6485 |
| 0.3865 | 0.6382 |
| 0.4102 | 0.6276 |
| 0.4348 | 0.6167 |
| 0.4605 | 0.6056 |
| 0.4871 | 0.5943 |
| 0.5148 | 0.5826 |
| 0.5433 | 0.5712 |
| 0.5728 | 0.5594 |
| 0.6032 | 0.5475 |
| 0.6344 | 0.5356 |
| 0.6663 | 0.5237 |
| 0.6990 | 0.5118 |
| 0.7324 | 0.4999 |
| 0.7663 | 0.4882 |
| 0.8009 | 0.4765 |
| 0.8359 | 0.4651 |
| 0.8713 | 0.4538 |
| 0.9071 | 0.4428 |
| 0.9432 | 0.4320 |
| 0.9794 | 0.4216 |

TABLE 1-continued

| NOZZLE DIMENSIONS | |
|---|---|
| X (inches) | Y (inches) |
| 1.0158 | 0.4114 |
| 1.0523 | 0.4016 |
| 1.0888 | 0.3922 |
| 1.1252 | 0.3631 |
| 1.1514 | 0.3744 |
| 1.1974 | 0.3662 |
| 1.2331 | 0.3583 |
| 1.2884 | 0.3510 |
| 1.3034 | 0.3440 |
| 1.3378 | 0.3374- |
| 1.3718 | 0.3313 |
| 1.4051 | 0.3257 |
| 1.4379 | 0.3204 |
| 1.4699 | 0.3156 |
| 1.5012 | 0.3111 |
| 1.5318 | 0.3071 |
| 1.5617 | 0.3034 |
| 1.5907 | 0.3001 |
| 1.6189 | 0.2971 |
| 1.6462 | 0.2944 |
| 1.6727 | 0.2921 |
| 1.6983 | 0.2900 |
| 1.7230 | 0.2882 |
| 1.7469 | 0.2867 |
| 1.7698 | 0.2854 |
| 1.7919 | 0.2843 |
| 1.8131 | 0.2834 |
| 1.8331 | 0.2826 |
| 1.8478 | 0.2822 |
| 1.8592 | 0.2819 |
| 1.8684 | 0.2817 |
| 1.8760 | 0.2815 |
| 1.8824 | 0.2814 |
| 1.8881 | 0.2813- |
| 1.8931 | 0.2813 |

By reducing the pressure drop associated with a conventional nozzle, nozzles 110, 111 made according to the present invention provide a shorter axial dimension and related smaller footprint for nozzle assembly 100, allowing the nozzle to fit within tight confines. For example, during situations where a collapsed bed occurs, the new smaller nozzle assembly 100 is primarily recessed back into the assembly 100 resulting in a more streamlined shape that can often be directly pulled out of a collapsed bed. In addition, such a configuration can save energy and potentially allow the use of a smaller pump and motor, as the same fluid volume and velocity at the exit of nozzles 110, 111 can be achieved with less pumping. Furthermore, the new nozzle assembly 100 consists of two smaller pieces with simpler and less costly manufacturing.

CFD and related flow simulation algorithms, as well as bench testing can be used to provide preferred decoking fluid flowpath shapes. It will be appreciated by those skilled in the art that an underlying CFD package may be developed specifically for the present application, or an off-the-shelf commercial code can be used to perform the CFD analyses discussed herein. CFD modelling can be used to demonstrate particular flow attributes, such as coherent flow, laminar or turbulent flow, locations where separated flow can be expected, or the like. In particular, CFD can be used to model particular nozzle internal profiles (i.e., flowpaths), such as the unique profile associated with the nozzles of the present invention. Such computational methods can take into consideration particular hydraulic attributes of the decoking fluid. Iterative approaches may also be employed to study the effects of flow perturbation and internal flowpath shape optimization. Such iterations could be based on simple starting geometries (such as tubular members, simple cones and other easily-defined configurations) that could then be modified to produce desirable flow attributes (such as a linear pressure drop along the flow axis). The optimization parameters may include minimizing the radial inflow at the exit throat of the nozzle and the standard deviation of the axial flow velocity (achieving thereby uniform flow across the exit throat). An additional benefit is that the resulting geometry can use well known similarity laws to allow scaling, depending on the size needs of the assembly 100. Hence, nozzles can be made for a variety of flows and pressures within the limits proscribed by fully developed turbulent flow the importance of which is that it allows for the linear conversion of kinetic and pressure energy, thereby making it easier to ensure accurate prediction of scaled designs.

While certain representative embodiments and details have been shown for purposes of illustrating the invention, it will be apparent to those skilled in the art that various changes may be made without departing from the scope of the invention, which is defined in the appended claims.

What is claimed is:

1. A fluid jet decoking tool comprising:

a decoking fluid delivery mechanism configured to receive a pressurized decoking fluid from a source; and a nozzle assembly selectively coupled to said decoking fluid delivery mechanism through a diverter plate, said nozzle assembly comprising:

a housing defining a decoking fluid conduit therein;

at least one cutting nozzle disposed within said housing and fluidly cooperative with at least a portion of said conduit; and at least one drilling nozzle disposed within said housing and fluidly cooperative with at least another portion of said conduit, each of said at least one cutting nozzle and said at least one drilling nozzle of said nozzle assembly defining an internal flowpath therein with an inlet, an outlet and a curvilinear tapered shape that converges along an axial length from said inlet to said outlet such that an axial dimension of said flowpath is less than two inches in length and a radial dimension of said flowpath is less than two inches in diameter.

2. The tool of claim 1, further comprising a shifting apparatus responsive to changes in pressure of a decoking fluid such that in a first operating condition, said shifting apparatus is cooperative with said tool and said decoking fluid to establish a drilling mode with said at least one drilling nozzle, while in a second operating condition, said shifting apparatus is cooperative with said tool and the decoking fluid to establish a cutting mode with said at least one cutting nozzle.

3. The tool of claim 1, wherein said housing and said at least one cutting nozzle define a width for said nozzle assembly such that said at least one cutting nozzle increases said width beyond a width of said housing by up to no more than about 10%.

4. The tool of claim 1, wherein less than about 15% of a length of said at least one cutting nozzle protrudes laterally beyond an outer dimension of said housing.

5. The assembly of claim 1, wherein said at least one cutting nozzle is substantially fixed relative to said housing.

6. The assembly of claim 1, further comprising a flow conditioner chamber formed immediately upstream of said inlet and in fluid communication with said conduit.

7. The tool of claim 1, wherein less than about 25% of a length of said at least one drilling nozzle resides outside of said housing.

8. The tool of claim 1, wherein said axial dimension of said flowpath is less than about 1.8931 inches in length and said radial dimension of said flowpath is less than about 1.68 inches in diameter.

* * * * *